United States Patent [19]

Kiura

[11] 3,986,257

[45] Oct. 19, 1976

[54] NAIL CLIPPER

[76] Inventor: Masao Kiura, 2-5-2-101 Asahigaoka, Kiyose, Tokyo, Japan

[22] Filed: Feb. 11, 1976

[21] Appl. No.: 657,274

[30] Foreign Application Priority Data

Feb. 15, 1975 Japan ..... 50-21170

[52] U.S. Cl. ..... 30/28; 30/124

[51] Int. Cl.[2] ..... B26B 17/04; A45D 29/02

[58] Field of Search ..... 30/28, 124, 125

[56] References Cited

UNITED STATES PATENTS

| | | | |
|---|---|---|---|
| 2,515,852 | 7/1950 | Bilsky | 30/28 |
| 2,837,821 | 6/1958 | David | 30/124 |
| 3,180,025 | 4/1965 | Tsunemi | 30/28 |
| 3,316,632 | 5/1967 | Bowers | 30/28 |

*Primary Examiner*—Al Lawrence Smith
*Assistant Examiner*—Gary L. Smith
*Attorney, Agent, or Firm*—Spensley, Horn & Lubitz

[57] ABSTRACT

A nail-nipper including a pair of elastic metal pieces secured together at one end and having a cutting edge formed on the other end, a shaft extending through the pair of elastic metal pieces at the cutting end, a pair of cover plates on opposite sides of the elastic metal pieces and a support lever pivotally coupled at its head end to the shaft, the head end of lever being relatively thick where it bears against one of the pair of elastic metal pieces and has a flat surface formed in its forward end edge. The flat surface formed in the forward edge of the head end of lever is arranged and configured together with pivot point such that when the lever is flipped into the vertical position the gap between the cutting edges is increased thereby allowing fingernail fragments trapped in the nail-nipper to be easily extracted.

6 Claims, 2 Drawing Figures

NAIL CLIPPER

FIELD OF INVENTION

The present invention relates to nail clippers and the like.

DESCRIPTION OF THE PRIOR ART

Nail clippers of a conventional type are arranged so that a pair of elastic metal pieces are biased away from each other and compressed by a lever to cause the nail clipping action with the pair of cutting edges formed on the respective tips of the elastic metal pieces. It is well known in the art to provide cover plates along the opposite sides of the pair of elastic metal pieces in order to avoid scattering of the nail fragments. However, such an arrangement has been disadvantageous in that it is difficult to remove the nail fragments which collect inside the nail clipper assembly.

SUMMARY OF THE INVENTION

In keeping with the principles of the present invention, the objects are accomplished with the unique combination of a pair of elastic metal pieces secured together at one end and in mutual relationship of one lying above the other and having a cutting edge formed at one end on each of the elastic metal pieces, a shaft extending through the pair of elastic metal pieces adjacent the cutter edge end, a pair of cover plates respectively provided at opposite sides of the elastic metal pieces, and a lever pivotally coupled to the shaft and holding the elastic metal pieces in compression. The end of the support level which is coupled to the shaft is the head end of the lever and is substantially thicker than the remaining portion of the lever. Furthermore the head bears against one of the elastic metal pieces and has a flat surface formed on its forward end. The flat surface formed in the head end of the lever is arranged and configured together with the shaft such that when the lever is moved to the vertical position with the flat surface engaging against one of the elastic metal pieces, the gap between the cutting edges is increased thereby allowing nail fragments contained in the nail clipper to be more easily removed.

Accordingly, it is a general object of the present invention to provide a nail-nipper from which it is easier to remove the fingernail fragments trapped within the nail-nipper.

It is another object of the present invention to provide a nail-nipper which does not scatter fingernail fragments about.

BRIEF DESCRIPTION OF THE DRAWINGS

The above mentioned and other features and objects of the present invention will become more apparent by reference to the following description taken in conjunction with the accompanying drawings, wherein like reference numerals denote like elements, and in which.

DESCRIPTION OF THE PREFERRED EMBODIMENT

Figure 1:
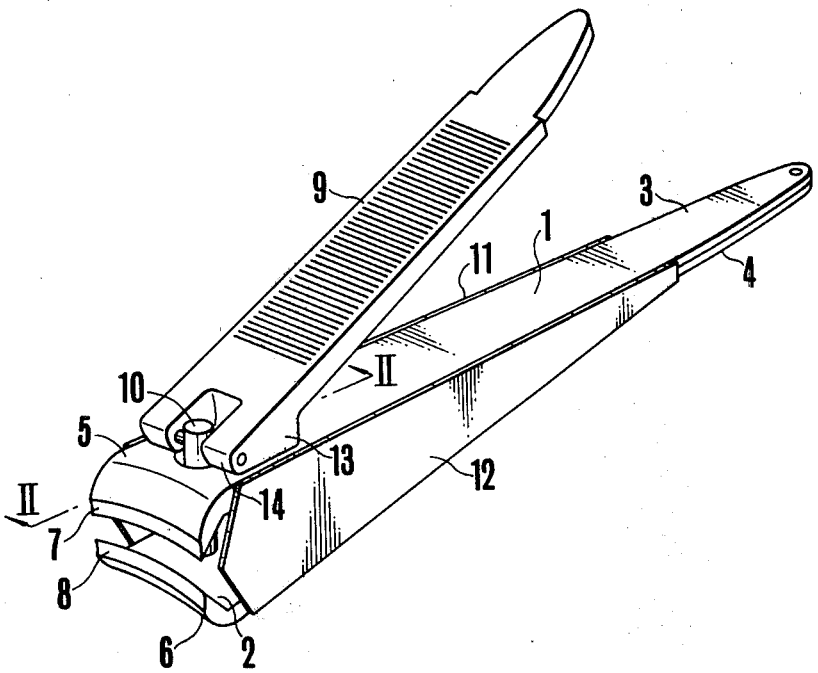
FIG. 1 is a perspective view of a nail-nipper in accordance with the teachings of the present invention.
Figure 2:
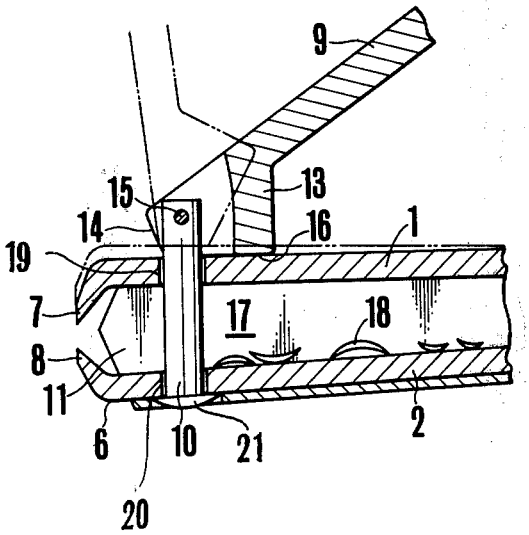
FIG. 2 is a sectional view of the embodiment of FIG. 1 taken along the II-II line.

Referring more specifically to the drawings, FIGS. 1 and 2 set forth sufficient detail to completely describe a nail-nipper in accordance with the teachings of the present invention.

In FIGS. 1 and 2, the nail-nipper includes a pair of elastic metal pieces 1 and 2. Elastic metal pieces 1 and 2 are adjacent one another in mutual relationship with one lying above the other and secured together at the ends 3 and 4. Cutting edges 7 and 8 are formed in the ends 5 and 6 of elastic metal pieces 1 and 2. A pair of cover plates 11 and 12 are provided on opposite sides of elastic metal pieces 1 and 2 and close the lateral openings in the sides between elastic metal pieces 1 and 2. Furthermore cover plates 11 and 12 are both coupled to elastic metal piece 2.

Shaft 10 extends through holes 19 and 20 respectively in elastic metal pieces 1 and 2. Shaft 10 further has a head 21 slightly larger in diameter than hole 20 in elastic metal piece 2. Lever 9 is pivotally coupled to shaft 10 by a pin 15 which extends through the head end 13 of lever 9 and shaft 10. Elastic metal pieces 1 and 2 are biased away from each other by the natural elasticity of the elastic metal pieces 1 and 2 but are held in compression between lever 9 and head 21 of shaft 10.

The head portion 13 of lever 9 is substantially thicker than the remainder of lever 9 and bottom flat surface 16 bears against the top surface of elastic metal piece 1 when in the normal position to be used to clip fingernails. The head portion 13 of lever 9 further has a flat surface 14 formed in the front part of head 13. Furthermore pin 15 is placed relative to flat surface 14 and bottom flat surface 16 such that the distance between pin 15 and flat surface 14 is less than the distance between pin 15 and bottom surface 16.

In practice the cover plates 11 and 12 may be made from plastic and could be formed in a single channel shaped piece. Also lever 9, shaft 10, and/or metal pieces 1 and 2 may be made from a suitable high strength plastic.

In normal operation with bottom surface 16 bearing against the top surface of elastic metal piece 1, the fingernail nipper can be used to clip fingernails. During the fingernail clipping process the fingernail fragments 18 which are clipped off by the fingernail nipper accumulate in the interior space 17 defined by elastic metal pieces 1 and 2 and cover plates 11 and 12. To remove the nail fragments 18 from the interior space 17, lever 9 is rotated to the vertical position such that flat surface 14 bears against the top surface of elastic metal piece 1. Since the distance from pin 15 to flat surface 14 is less than the distance from pin 15 to bottom surface 16, elastic metal pieces 1 and 2 move away from each other as a result of their natural elasticity and their outward biase. Furthermore, when elastic metal pieces 1 and 2 move apart, cutting edges 7 and 8 move apart thereby increasing the gap between cutting edges 7 and 8. Since the gap between 7 and 8 is larger, the removal of the nail fragments 18 contained in the interior space 17 is facilitated.

It is obvious from the aforegoing description that, in accordance with the principles of the present invention, the head portion 13 of lever 9 is formed with respect to the rest of lever 9 such that the head portion 14 is provided at the front end with a flat surface 14 so that lever 9 may be easily and steadily erected on flat surface 14 substantially at right angles to the top surface of elastic metal piece 1 thereby increasing the spacing between the pair of elastic metal pieces 1 and 2 and the cutting edges 7 and 8 to facilitate the removal of nail fragments 18 contained in the interior space 17.

In all cases it is understood that the above described embodiment is merely illustrative of but a small number of the many possible specific embodiments which represent the application of the principles of the present invention. Furthermore, numerous and varied other arrangements can be readily devised in accordance with the principles of the present invention by those skilled in the art without departing from the spirit and scope of the invention.

I claim:

1. A nail-nipper comprising:

a pair of elastic pieces, one disposed over the other and coupled together at one end, and spaced apart at the other ends of the plastic pieces;

a cutting edge formed in the other end of each of the elastic pieces;

a pair of cover plates on opposite sides of the elastic pieces and closing the lateral openings between the elastic pieces, said cover plates being coupled to one of said elastic pieces;

a shaft extending through a pair of aligned holes in said elastic pieces, said shaft having a head at one end which is slightly larger in diameter than said holes, the underside of said head bearing on an outer surface of one of said elastic pieces; and a lever having a head end which is substantially thicker than the rest of said lever, said head end being pivotally coupled to said shaft and holding said pair of elastic pieces in compression between said head end of said lever and said head of said shaft, said head end further having a bottom surface which bears against the other outer surface of one of said elastic pieces during normal operation of said nail-nipper and a flat surface formed in the front end of said head, said head end arranged and configured such that the distance between said flat surface and the pivot of said lever is less than the distance between said bottom surface and the pivot of said lever, when said lever is pivoted to a position wherein said flat surface bears on said other outer surface of one of said elastic pieces the elastic pieces are allowed to move apart thereby facilitating removal of nail fragments which may become stored in the nail-nipper.

2. A nail-nipper according to claim 1 wherein said elastic-pieces are made of metal.

3. A nail-nipper according to claim 1 wherein said lever is pivotally coupled to said shaft by a pin.

4. A nail-nipper according to claim 1 wherein said cover plates are made of plastic.

5. A nail-nipper according to claim 1 wherein said cover plates are made of metal.

6. A nail-nipper according to claim 1 wherein said lever is made of plastic.

* * * * *